US007677183B2

(12) United States Patent
Borggaard

(10) Patent No.: US 7,677,183 B2
(45) Date of Patent: Mar. 16, 2010

(54) PALLET WITH WALLS HINGED TO SUPPORT PLATE

(75) Inventor: René Bennet Borggaard, Stenlille (DK)

(73) Assignee: Gravenhorst Plast A/S, Jaegerspris (DK)

( * ) Notice: Subject to any disclaimer, the term of this patent is extended or adjusted under 35 U.S.C. 154(b) by 0 days.

(21) Appl. No.: 11/822,347

(22) Filed: Jul. 5, 2007

(65) Prior Publication Data

US 2008/0011204 A1 Jan. 17, 2008

Related U.S. Application Data

(63) Continuation of application No. 10/543,622, filed on Sep. 7, 2005, now abandoned.

(51) Int. Cl.
*B65D 19/00* (2006.01)

(52) U.S. Cl. ..... 108/51.11; 108/57.32

(58) Field of Classification Search ..... 108/51.3, 108/51.11, 57.25, 901, 902, 162, 166, 115; 248/346.02; 206/386, 599, 600; 312/258, 312/259, 262, 263

See application file for complete search history.

(56) References Cited

U.S. PATENT DOCUMENTS 2,709,559 A * 5/1955 Geisler ..... 108/51.3
2,894,671 A * 7/1959 Nicholls ..... 108/51.3
2,928,578 A * 3/1960 Parker ..... 108/51.3
2,989,226 A * 6/1961 Swartz ..... 229/125.19
3,410,441 A * 11/1968 Rhyne ..... 312/263
4,372,221 A * 2/1983 White ..... 108/51.3
4,378,743 A * 4/1983 McFarland ..... 108/51.3
4,507,348 A * 3/1985 Nagata et al. ..... 108/57.25
4,561,706 A * 12/1985 Grati ..... 312/258
4,717,025 A * 1/1988 Maurer ..... 206/599
4,782,972 A * 11/1988 Wenkman et al. ..... 312/263
5,285,732 A * 2/1994 Gottlieb ..... 108/51.3
5,473,995 A * 12/1995 Gottlieb ..... 108/51.3
5,528,995 A * 6/1996 Lim ..... 108/51.3
5,539,956 A * 7/1996 Wallace ..... 16/261
5,613,447 A * 3/1997 Trickett ..... 108/57.16
5,655,825 A * 8/1997 Anoszko ..... 312/262
6,041,718 A * 3/2000 Brandes et al. ..... 108/51.3
6,070,726 A * 6/2000 Graham ..... 206/386
6,250,234 B1 * 6/2001 Apps ..... 108/57.25

FOREIGN PATENT DOCUMENTS

DE 4034481 A1 * 5/1992
DK 200300037 3/2003

* cited by examiner

*Primary Examiner*—José V Chen
(74) *Attorney, Agent, or Firm*—Dykema Gossett PLLC

(57) ABSTRACT

The present invention relates to a pallet comprising a four-sided support plate, said support plate comprising two first edges arranged opposite each other and two second edges arranged opposite each other, first walls arranged along the first edges of support plate and hinged to the support plate.

35 Claims, 4 Drawing Sheets

PALLET WITH WALLS HINGED TO SUPPORT PLATE

CROSS-REFERENCE TO RELATED APPLICATION

This application is a continuation of application Ser. No. 10/543,622, filed Sep. 7, 2005 (now abandoned).

BACKGROUND OF THE INVENTION

1. Field of the Invention

This invention relates to a load carrying pallet, and to a method for using such pallet.

2. The Prior Art

Although pallets have substantial advantages in improving the mechanical handling of goods and commercial products, their use have some disadvantages in respect to handling the pallet when unloaded. Since most pallets are being recycled or returned to the manufacturer of the goods or the warehouse from which they were shipped, the handling of the empty pallet is involving considerable handling costs. Furthermore, the empty pallets occupy space that could have been otherwise available for other purposes in the store/warehouse, or during transport/logistics.

A pallet of the type, requiring only a little space when empty is known from GB 2 061 871 A. The pallet described in this reference refers to a load carrying pallet comprising a base section having a surface layer and two support elements also having surface layers in contact with and secured to the surface layer of the base section, integrally formed and connected by an flexible hinge portion to said surface layer of the base section. The pallet is constructed of cardboard as a single element and comprised of respective outer layers of cardboard. Interposed a sandwiched honey-comb structure made of paper is arranged.

The pallet described in GB 2 061 871 A is intended for carrying both light weight goods and heavy goods. However, the construction is vulnerable to damage when handled by a fork-lift truck and especially when the support elements are subjected to relatively large laterally-directed forces the walls are vulnerable of collapsing.

It is therefore an object of the invention to provide a pallet of the above type that is more stable, and where the support elements are capable of withstanding relatively large laterally-directed forces.

SUMMARY OF THE INVENTION

This object is obtained in accordance with the invention with a pallet of the above-defined type, which is characterized in that the pallet further comprises two second walls arranged along at the two second sides of said support plate and hinged hereto, and that said first walls and said second walls are connectable to each other.

In accordance with the application, the invention provides according to an aspect a pallet, wherein the first walls and the second walls comprise engagement means for connecting said first walls to said second wall, whereby said walls provide a stable construction for the support plate.

In accordance with a preferred embodiment of the invention, the pallet comprise releasable engagement means, whereby the foldable pallet may be brought to reassume a flattened state.

In accordance with another preferred embodiment of the invention the engagement means provide a snap-lock, whereby the engagement of said first and second walls allow a quickly assembly of the pallet.

In accordance with other preferred embodiments of the invention, the first walls and the second walls are hinged to the support plate by use of film-like hinge areas of reduced thickness, and the film-like hinge areas of reduced thickness are integrally molded areas of the pallet, whereby a sturdy construction of the pallet is achieved.

In accordance with a further preferred embodiment of the invention, the second walls have at least one, preferably two openings, and said opening being a recess extending towards said hinge from an edge of the second walls opposite the hinge, whereby there is obtained an opening for the insertion of the tines of a fork-lift.

In accordance with yet a further preferred embodiment of the invention, the two recesses are arranged symmetrically about a centre axis of said second walls, and extending towards the first walls, said centre axis being perpendicular to said film-like hinge areas of reduced thickness, whereby a central support element 16 is obtained.

In accordance with another further preferred embodiment of the invention, the support plate comprises a first sheet and a second sheet, and welded or molded together, and that the first walls and the second walls comprise a first sheet and a second sheet, welded or molded together, whereby a particular light construction of a pallet is obtained.

In accordance with an yet another further preferred embodiment of the invention, the first sheet is kept a distance from said second sheet by means of separate distance pieces, said distance pieces being welded to said sheets, whereby a particular light and strong construction of a pallet is obtained.

In accordance with an yet another preferred embodiment of the invention, the first sheet is kept at a distance from said second sheet by means of distance pieces, said distance pieces being bulges protruding from said second sheet, and that said bulges being welded to said first sheet, whereby a yet particular light and strong construction of the pallet is obtained.

In accordance with a yet another preferred embodiment of the invention, the support plate, the first walls, and the second walls are solid, or substantively solid, where by a strong construction of the pallet is obtained.

In accordance with another preferred embodiment of the invention, the first edges of the support plate and the first walls have an extension of about 1200 mm, or 1200 mm; and that second edges of the support plate and the second walls have an extension of about 800 mm, or 800 mm, whereby a pallet of a preferred dimension is obtained.

In accordance with yet another preferred embodiment of the invention, the first edges of the support plate and the first walls have an extension of about 1200 mm, or 1200 mm; and that second edges of the support plate and the second walls have an extension of about 1000 mm, or 1000 mm, whereby a pallet of another preferred dimension is obtained.

In accordance with another preferred embodiment of the invention, after use of the pallet for transporting goods said walls are disconnected from one another, whereby a pallet that requires little space in storage is obtained.

The invention will be explained in greater detail in the following with reference to the accompanying drawing.

DETAILED DESCRIPTION OF THE PREFERRED EMBODIMENTS

Figure 1:
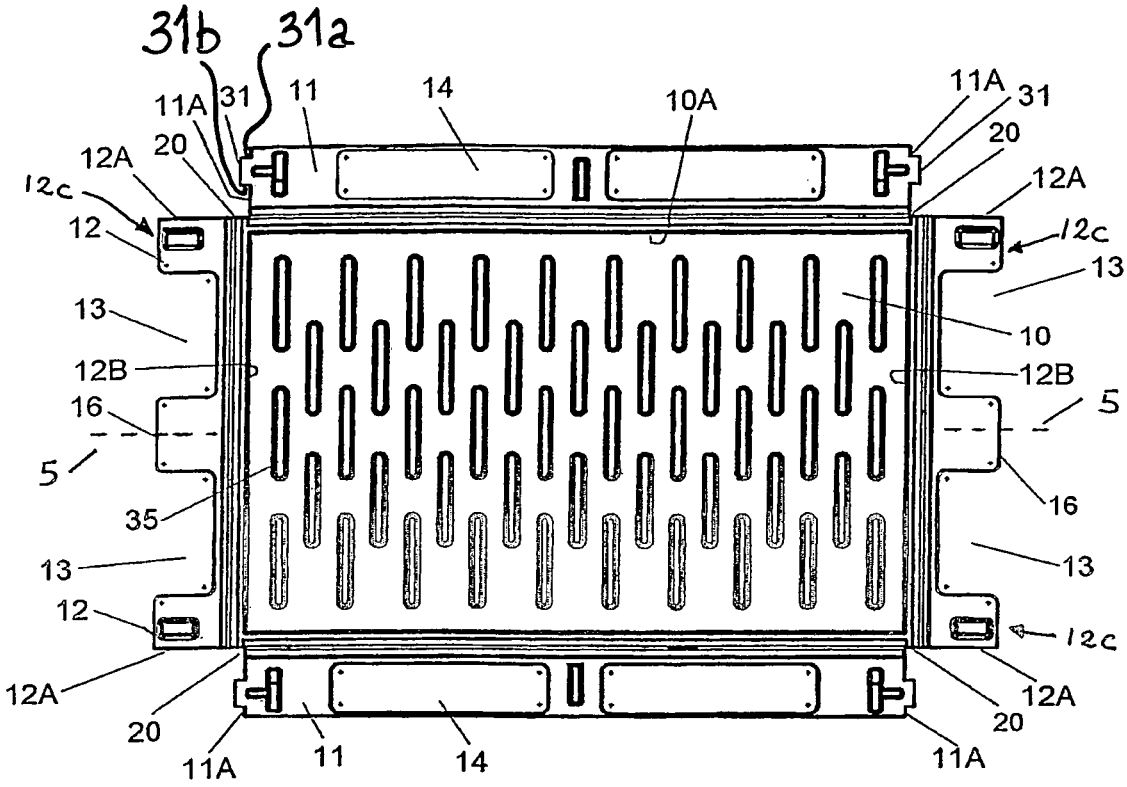
FIG. 1 shows a bottom plan view of a pallet according to the invention in a flattened condition and showing its base section, walls and engagement means.

Turning now to FIG. 1 of the drawings there is illustrated a bottom plane view of the pallet in a collapsed state, the pallet comprising a support plate 10 (base section), two first walls 11 arranged at opposite edges at the support plate 10 (base section) and two second walls 12 arranged at two other opposite edges at said support section 10. The first walls 11 and the second walls 12 are hinged to the support plate 10 by film-like hinge areas of reduced thickness 20, whereby said film-like hinge areas of reduced thickness 20 are preferably integrally molded parts of the pallet (10). The walls 11, 12 comprise edges 11*a*, 12*a* perpendicular to the film-like hinge areas of reduced thickness 20, and at said edges 11*a*, 12*a* the walls 11, 12 comprise engagement means arranged for the engagement of the first wall 11 with the second wall 12. A center axis 5 is arranged symmetrically, or substantially symmetrically to the second edges.

Figure 2A:
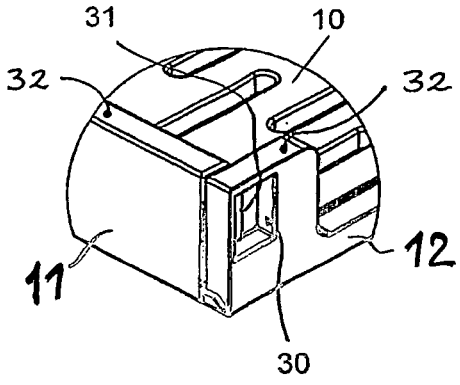
FIG. 2*a* shows the engagement means seen from the outside of the assembled pallet.
Figure 2B:
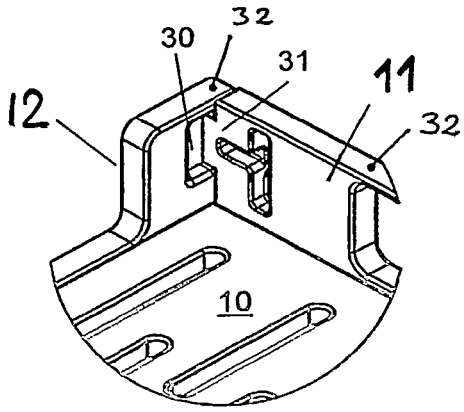
FIG. 2*b* shows the engagement means seen from the inside of the assembled pallet.

In FIGS. 2*a* and 2*b* there is illustrated a section of the pallet from two view points showing in greater details the engagement means, the pallet being in this state, ready for use with the walls 11, 12 being connected. In the preferred embodiment, the engagement means is a snap-lock where the edge 11*a* of first wall 11 comprise a protruding ear 31 being flexible and allowing a spring like movement of the protruding ear 31. The second wall 12 comprise an opening 30 arranged for the insertion of the protruding ear 31, thereby providing an engagement between the first wall 11 and the second wall 12. It can be seen that the protruding ear has generally parallel sides 31*a*, 31*b*, and the ear 31 does not extend beyond the thickness of the wall 12. As will appear from the figures, the edges 32 will, when the pallet is assembled and placed on the floor constitute the contact faces between the floor, and the walls 11, 12.

Alternatively, yet another opening (not shown) could be arranged in the first wall 11, and the protruding ear 31 could be constituted by a separate clamp (not shown) arranged for the insertion in said openings thereby providing a snap-lock for the engagement of said first wall 11 to said second wall 12.

Turning again to FIG. 1, the second walls 12 each comprises two recesses 13 extending towards said film-like hinge areas of reduced thickness 20 (hinge) from an edge 12*c* of the second wall 12 opposite the hinge.

By this construction there is provided a central support element 16 which serves to reduce the bending moments in the support section (10), which bending moments among other factors are dependent of the unsupported span of the support plate (10).

The two recesses 13 provide space for the insertion of the tines of a fork-lift truck (not shown) such that the pallet may be lifted by the fork-lift truck. It will be noted that, the recesses 13 preferably have an extent towards the hinge like areas of reduced thickness 20 whereby the tines of the fork-lift upon insertion of the tines will contact the surface of the downside of the support section, thereby providing contact of the tines with the surface of the downside of the support plate.

Figure 3:
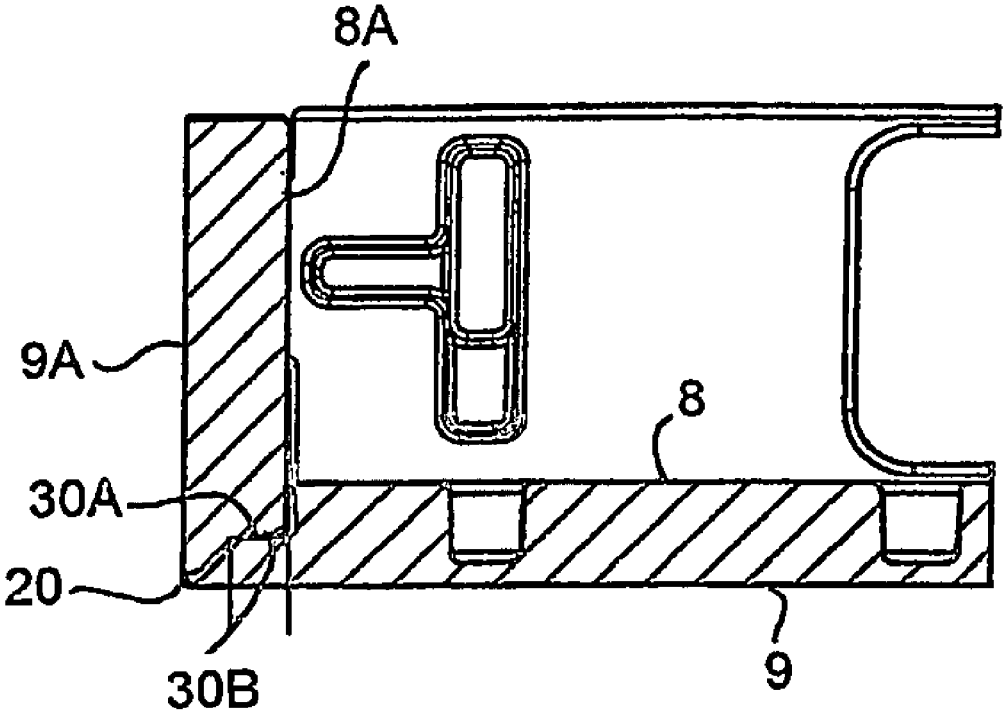
FIG. 3 shows in a cross-section of the assembled pallet.

Now turning to FIG. 3 a cross-sectioned view of the pallet at the hinged edge between one of the walls 11, 12 and the support plate (base section) 10 is illustrated, the pallet being shown in an up-side-down position. The support plate 10 (base section) comprise a support surface 9 and a downside 8, where said support surface 9 is arranged for carrying the goods/products to be transported or stored.

As will appear from FIG. 3 the walls 11, 12 comprise a contact face 30*a* extending perpendicular to a side surface 9*a* of the walls 11, 12 arranged in the area of the hinge like area of reduced thickness 20. A similar contact face 30*b* of support plate 10 is arranged at the edges 10*a*, 10*b* of the support plate 10, said contact face 30*b* extending parallel to the support surface 9 of the support plate 10 towards the hinge like areas of reduced thickness 20.

When assembled, the first walls and the second walls are both pivoted about the film-like hinge areas of reduced thickness 20, preferably at an angle of 90° whereby the first contact face 30*a* and the second contact face 30*b* abut each other thereby ensuring that forces related to the goods loaded on the support surface (support plate) are distributed from the contact faces 30*a*, 30*b* through the walls to the base (floor).

It should be noted that the thickness of the pallet (of the walls 11, 12 and the support plate 10) and the extent of the contact face 30*a*, 30*b* will be selected in accordance with the loads to be carried and the actual size of the pallet, and furthermore in some special cases is dependent on the construction of the pallet among these if the pallet is solid or the sandwich board type.

Figure 4:
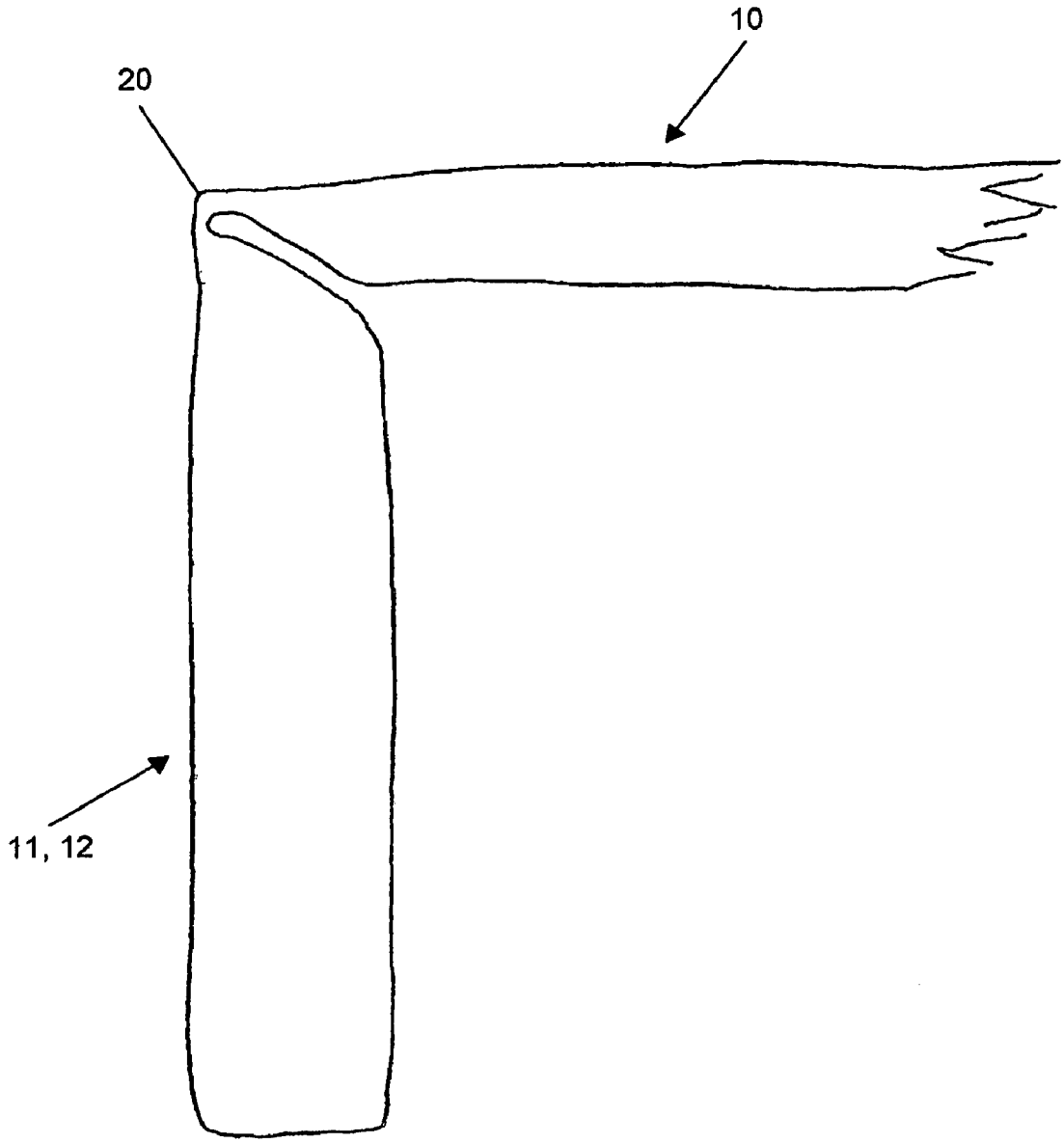
FIG. 4 shows a cross-section of the pallet in a preferred embodiment.

In FIG. 4, an intersected cross section of a preferred embodiment of the pallet is illustrated in the area of the hinged edge (the film like areas of reduced thickness 20) between a wall 11, 12 and the support plate 10 is illustrated. From the figure it will appear that the pallet may be constructed of a solid plate material, or of a substantially solid plate material. Preferably the pallet is constructed of plastic materials and more preferably a thermo plastic material. In some special cases the pallet is constructed of a reinforced plastic material comprising fibers, e.g.: Glass fibers, Carbon fibers. In some other special cases the pallet is constructed of reinforced plastic material comprising or the pallet may be comprise a reinforcement of steel or aluminum in the form of a reinforcement mat, a wire netting or bars.

Figure 5:
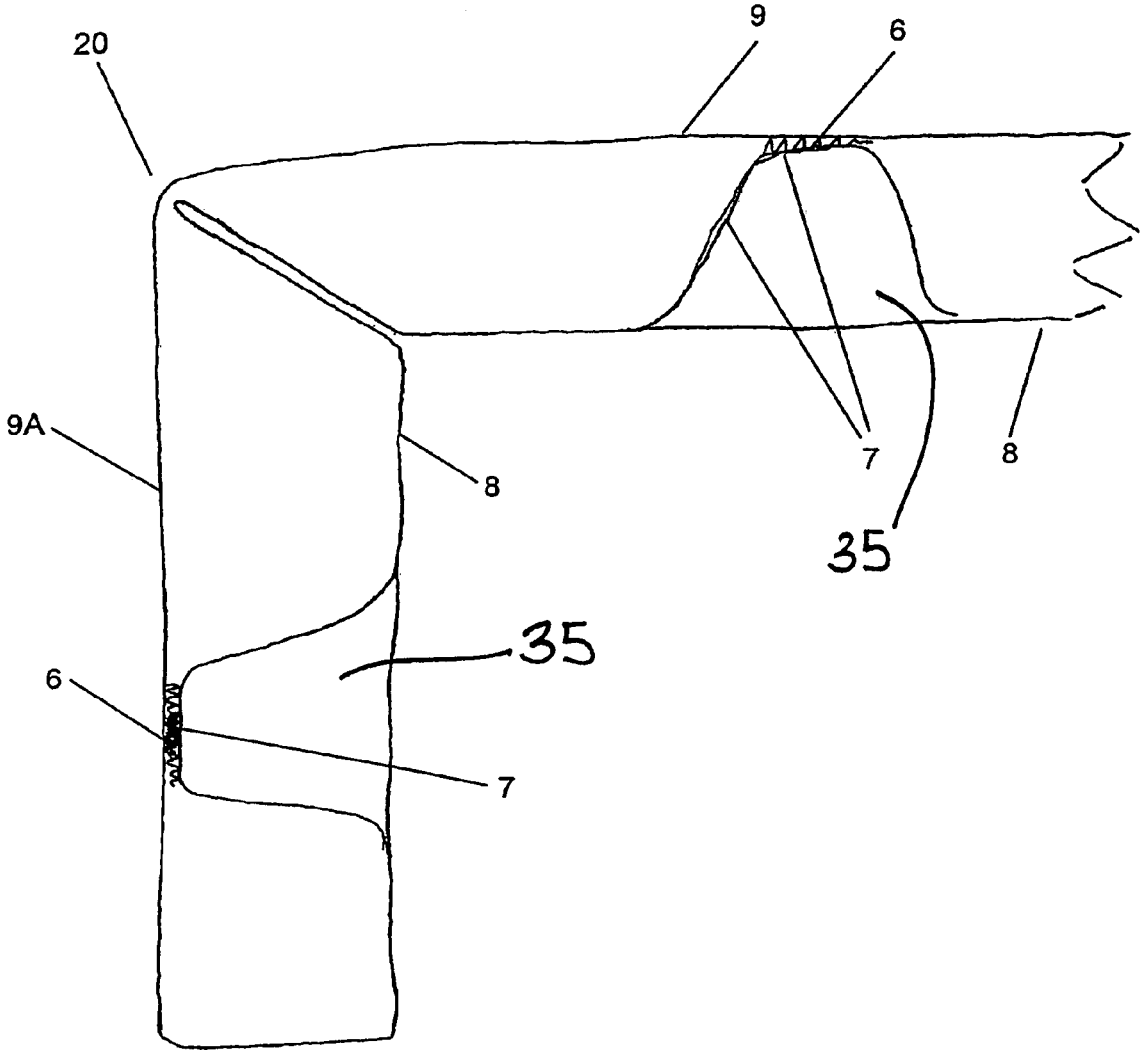
FIG. 5 shows a cross-section of the pallet in another preferred embodiment.

In FIG. 5, an intersected cross section of a preferred embodiment of the pallet is illustrated. The intersected section shows the pallet at the hinged edge (the film like areas of reduced thickness 20) between a wall 11, 12 and the support plate 10. Further in FIG. 5, a cross section of an assembled pallet is shown. As will appear from FIG. 5, the pallet is a sandwich board type comprising a first sheet 9 and a second sheet 8, where said second sheet 8 comprise distance pieces being bulges 35 protruding from the surface of said second sheet 8. The bulges 35 form a plurality of rows of distance pieces (supporting points) in the second sheet which are subsequently attached to the first sheet. The first sheet 9 and second sheet 8 are joined along the edges 10*a*, 10*b* of the pallet preferably by molding techniques or by welding techniques commonly know by the person skilled in the art of plastics fabrication/productions. Furthermore, the bulges 35 protruding from the surface of said second sheet 8 are spot welded to the inner surface of the first sheet 9, said spot welding being indicated with the reference sign 6.

Furthermore, it should be noted that the pallet may be transported or stored when unloaded in the form illustrated in FIG. 1. That is the pallet may be transported or stored in its flat form, in combination with its light-weight construction that there may be substantial savings in relation to pallets of conventional types, e.g. the EU-pallet of wood.

The invention claimed is:

1. A pallet comprising:

a four-sided support plate which defines two first edges arranged opposite each other and two second edges arranged opposite each other, first side walls arranged along the first edges of said support plate and hinged to the support plate to be pivotable between an inactive position generally coplanar with the support plate and an active position generally perpendicular to said support plate, said first side walls including first engagement means at opposite ends thereof, second side walls arranged along the two second edges of said support plate and hinged to the support plate to be pivotable between an inactive position generally coplanar with the support plate and an active position generally perpendicular to the support plate, said second side walls including second engagement means at respective opposite ends thereof, said first and second engagement means being engageable when said first and second side walls are respectively pivoted to said active positions to lock the first and second side walls together, said first and second engagement means being selected from openings and protrusions which fit into said openings, said protrusions being generally planar with the side walls from which they extend and extending perpendicularly to the side walls which provide the respective openings in which the protrusions extend, and wherein the second side walls have at least one recess through which tines of a forklift can extend to carry said pallet.

2. The pallet according to claim 1, wherein the first side walls and the second side walls are hinged to the support plate by film-like hinge areas of reduced thickness which provide hinges.

3. The pallet according to claim 2, wherein each said recess extends towards a hinge from an edge of the second side walls opposite the hinge.

4. The pallet according to claim 2, wherein two recesses are arranged symmetrically about a centre axis of said second side walls and extending towards the first side walls, said centre axis being perpendicular to said film-like hinge areas of reduced thickness.

5. The pallet according to claim 2, wherein the film-like hinge areas of reduced thickness are integrally molded areas of the pallet.

6. The pallet according to claim 1, wherein the support plate, the first side walls and the second side walls are generally solid.

7. The pallet according to claim 1, wherein said first edges of the support plate and the first side walls have an extension of about 1200 mm, and second edges of the support plate and the second side walls have an extension of about 800 mm.

8. The pallet according to claim 1, wherein said first edges of the support plate and the first side walls have an extension of about 1200 mm, and said second edges of the support plate and the second side walls have an extension of about 1000 mm.

9. The method of using the pallet according to claim 1, wherein after use of the pallet for transporting goods, said side walls are disconnected from one another.

10. The pallet according to claim 1, wherein said pallet is molded from a thermoplastic material, wherein said support plate comprises a support surface facing away from said first and second side walls, and a down side, and wherein edges of said first and second side walls opposite said hinges define a contact face between said pallet and a floor.

11. The pallet according to claim 10, wherein upon release of said engagement means, said hinges allow said first and second side walls to be pivoted such that the pallet assumes a flattened state.

12. The pallet according to claim 11, wherein said protrusions snap-lock in said openings when said first and second side walls are pivoted about said hinges from said flattened state.

13. The pallet according to claim 1, wherein the support plate comprises a first sheet and a second sheet, welded or molded together.

14. The pallet according to claim 1, wherein the first side walls and the second side walls comprise a first sheet and a second sheet, welded or molded together.

15. The pallet according to claim 14, wherein said first sheet is kept a distance from said second sheet by means of separate distance pieces, said distance pieces being welded to said sheets.

16. The pallet according to claim 14, wherein said second sheet forms bulges which extend to said first sheet to space said first sheet from said second sheet, said bulges being welded to said first sheet.

17. The pallet according to claim 1, wherein said protrusions do not extend in respective openings beyond a thickness of the side walls containing the respective openings.

18. The pallet according to claim 1, wherein said protrusions define generally parallel side walls.

19. The pallet according to claim 1, wherein said support plate includes first ledge portions at the first and second edges thereof and said first and second side walls include second ledge portions at edges thereof adjacent said support plate so that when said first and second side walls are oriented generally perpendicularly to said support plate and said protrusions extend into the openings of said engagement means, said first and second ledge portions will engage to distribute weight of goods placed on the support plate onto a supporting surface thereunder.

20. A pallet comprising:

a four-sided support plate, said support plate comprising two first edges arranged opposite each other and two second edges arranged opposite each other, first side walls arranged along respective first edges of said support plate with sides of said first side walls respectively hinged to said first edges to be pivotable between an inactive position generally coplanar with the support plate and an active position generally perpendicular to said support plate, said first side walls including first engagement means at opposite ends thereof, second side walls arranged along the respective second edges of said support plate with sides of said second walls respectively hinged to said second edges to the support plate to be pivotable between an inactive position generally coplanar with the support plate and an active position generally perpendicular to the support plate, said second side walls including second engagement means at respective opposite ends thereof, said first and second engagement means being engageable when said first and second side walls are respectively pivoted to said active positions to releasably snap lock the first and second side walls together, said first and second engagement means being selected from openings and protrusions which fit into said openings, said protrusions being generally planar with the side walls from which they extend and extending perpendicularly to the side walls which provide the respective openings in which the protrusions extend, and wherein the second side walls have at least one recess extending towards a hinge from an edge of the second side walls opposite the hinge whereby said pallet may be carried by tines of a forklift engaging the support plate.

21. The pallet according to claim 20, wherein said pallet and said snap-locks are integrally molded from a thermoplastic material, wherein said support plate comprises a support surface facing away from said first and second side walls, and a down side, and wherein edges of said first and second side walls opposite said hinges define a contact face between said pallet and a floor.

22. The pallet according to claim 21, wherein upon release of said snap-locks, said hinges allow said first and second side walls to be pivoted such that the pallet assumes a flattened state.

23. The pallet according to claim 22, wherein the snap-locks are configured to engage when said first and second side walls are pivoted about said hinges from said flattened state.

24. The pallet according to claim 20, wherein the first side walls and the and the second side walls are hinged to the support plate by respective film-like hinge areas of reduced thickness.

25. The pallet according to claim 24, wherein the film-like hinge areas of reduced thickness are integrally molded areas of the pallet.

26. The pallet according to claim 24, wherein two recesses are arranged symmetrically about a centre axis of said second side walls, and extending towards the first walls, said centre axis being perpendicular to said film-like hinge areas of reduced thickness.

27. The pallet according to claim 20, wherein the support plate comprises a first sheet and a second sheet welded or molded together.

28. The pallet according to claim 27, wherein said first sheet is kept a distance from said second sheet by means of separate distance pieces, said distance pieces being welded to said sheets.

29. The pallet according to claim 27, wherein said second sheet forms bulges which extend to said first sheet to space said first sheet from said second sheet, said bulges being welded to said first sheet.

30. The pallet according to claim 20, wherein the first side walls and the second side walls comprise a first sheet and a second sheet, welded or molded together.

31. The pallet according to claim 1, wherein said protrusions are one-piece with respective walls.

32. The pallet according to claim 20, wherein said protrusions are one-piece with respective walls.

33. The pallet according to claim 20, wherein said protrusions do not extend in respective openings beyond a thickness of the side walls containing the respective openings.

34. The pallet according to claim 20, wherein said protrusions define generally parallel side walls.

35. The pallet according to claim 20, wherein said support plate includes first ledge portions at the first and second edges thereof and said first and second side walls include second ledge portions at edges thereof adjacent said support plate so that when said first and second side walls are oriented generally perpendicularly to said support plate and said protrusions extend into the openings of said engagement means, said first and second ledge portions will engage to distribute weight of goods placed on the support plate onto a supporting surface thereunder.

* * * * *